US005882056A

United States Patent [19]

Broadwell

[11] Patent Number: 5,882,056

[45] Date of Patent: Mar. 16, 1999

[54] HELMET AND EQUIPMENT HOLDER

[76] Inventor: James W. Broadwell, 4254 S. 6115 W., West Valley City, Utah 84128

[21] Appl. No.: 961,257

[22] Filed: Oct. 30, 1997

[51] Int. Cl.[6] ..... B65D 71/00

[52] U.S. Cl. ..... 294/158; 294/168; 224/255; 224/257

[58] Field of Search ..... 294/19.1, 137, 294/153, 156, 158, 159, 161, 167, 168, 141, 142; 224/103, 255, 258, 270

[56] References Cited

U.S. PATENT DOCUMENTS

| | | | |
|---|---|---|---|
| 109,156 | 11/1870 | Taylor | 294/156 |
| 2,515,826 | 7/1950 | Hall | 294/153 |
| 2,539,496 | 1/1951 | Towey | 294/158 |
| 4,717,147 | 1/1988 | Rochelle | 294/117 |
| 4,826,231 | 5/1989 | Bakhit | 294/158 |
| 5,150,938 | 9/1992 | Gans | 294/158 |
| 5,234,245 | 8/1993 | Peterson et al. | 294/158 |
| 5,294,005 | 3/1994 | Hedges | 211/13 |
| 5,318,084 | 6/1994 | Jackson | 224/258 |
| 5,361,956 | 11/1994 | Racanati | 294/159 |
| 5,441,323 | 8/1995 | Goddard | 294/158 |
| 5,487,581 | 1/1996 | Carmo et al. | 294/137 |
| 5,713,617 | 2/1998 | Marinaro | 294/19.1 |

*Primary Examiner*—Dean Kramer
*Attorney, Agent, or Firm*—David H.T. Wayment

[57] ABSTRACT

A carrier for protective sports helmets having ear holes is disclosed. The carrier is also capable of carrying other types of equipment. The carrier is a telescopic pole of two sections with a compression knob which allows the pole to be locked at a particular length. A fabric strap with swivel hooks is attached to a ring at either end of the pole. The fabric strap has a pad which makes the invention easier to carry on the shoulder of the user. The user will detach one end of the fabric strap and slide the telescopic pole through the ear holes of the protective helmets. The user will then reattach the fabric strap and use the fabric strap to carry the pole and helmets.

5 Claims, 2 Drawing Sheets

HELMET AND EQUIPMENT HOLDER

BACKGROUND OF THE INVENTION

1. Field of the Invention

This invention relates generally to the holding of athletic equipment. Specifically, the invention is designed to facilitate the holding of protective helmets and related equipment.

2. Description of Related Art

Participants in a number of sports, such as baseball, football, hockey, etc., often wear protective helmets. The use of these helmets has grown dramatically as their benefit has been demonstrated. Usually, these helmets are comprised of a rigid, outer plastic shell and an inner, foam liner. Typically, these helmets have a portion which extends down over one or both ears of the wearer. The ear portion of the helmet generally includes a hole to facilitate hearing.

While the benefits of these helmets are undeniable, the helmets do present difficulties in transportation and storage. The helmets are used in team sports with a number of players, thus requiring a plurality of helmets. The rigid nature of the helmets makes them bulky to carry. In an effort to reduce bulk, the end users of the helmets have often stacked them inside each other, which has the tendency to damage the foam liner. Alternatively, end users have simply dumped a plurality of helmets into a duffle bag, which causes the helmets to bang and rub against each other while being carried. Both methods of carrying helmets have been shown, by long experience, to result in damage to the helmets, and loss of the helmets due to the disorganized method of transport and storage.

One approach to solving the foregoing problems is shown in U.S. Pat. No. 4,826,231 by Bakhit. The Bakhit invention is certainly an improvement over the prior art: it provides a carrying device for helmets with a solid rod of fixed length having a foldable handle at one end and a fixed base at the other end.

Nevertheless, there exists an unmet need for an improved helmet holder. Such an improved holder would have a strap to provide for easier carrying of the carrier. The improved holder would also be of adjustable length. The improved holder would also allow for the easy removal of helmets from either end of the holder, rather than from just one end.

SUMMARY OF THE INVENTION

A holder for protective helmets and related equipment meeting the foregoing needs is disclosed. The holder is comprised of an adjustable insertion means which is capable of receiving a plurality of helmets, and a carrying means which facilitates carrying the holder. The insertion means is a two-piece metal pole with two segments of diameters such that one segment can slide into the other segment, and a locking compression knob assembly of the type well known in the art (seen on extendable poles used, for example, as shower rods). The pole has two ends, and at each end is a metal clip and ring which permit the carrying means to be attached.

The carrying means is a fabric (preferably a synthetic material such as Nylon) strap having a padded section, slidable buckles, and swivel clips. The padded section is comprised of foam rubber covered with fabric. The slidable buckles and swivel clips (both of which are well known in the art) can be made of metal or a hard plastic. The clips detachably engage the rings on the pole. The slidable buckles allow the length of the strap to be adjusted for user comfort. The overall length of the holder will be about two feet when fully collapsed, and about four feet when fully extended. Each segment is about two feet long. The strap will be about five feet long when adjusted for maximum length, with a padded section about one foot long.

It is an object of the invention to provide a holder for helmets and related athletic equipment which stores the equipment without damage.

It is a further object of the invention to provide a holder for helmets and related athletic equipment which permits increased organization of the equipment.

It is a further object of the invention to provide a holder for helmets and related athletic equipment which is adjustable in length.

It is a further object of the invention to provide a holder for helmets and related athletic equipment which allows the equipment to be loaded and unloaded from either end of the invention.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the claims.

DESCRIPTION OF THE PREFERRED EMBODIMENT

Figure 1:
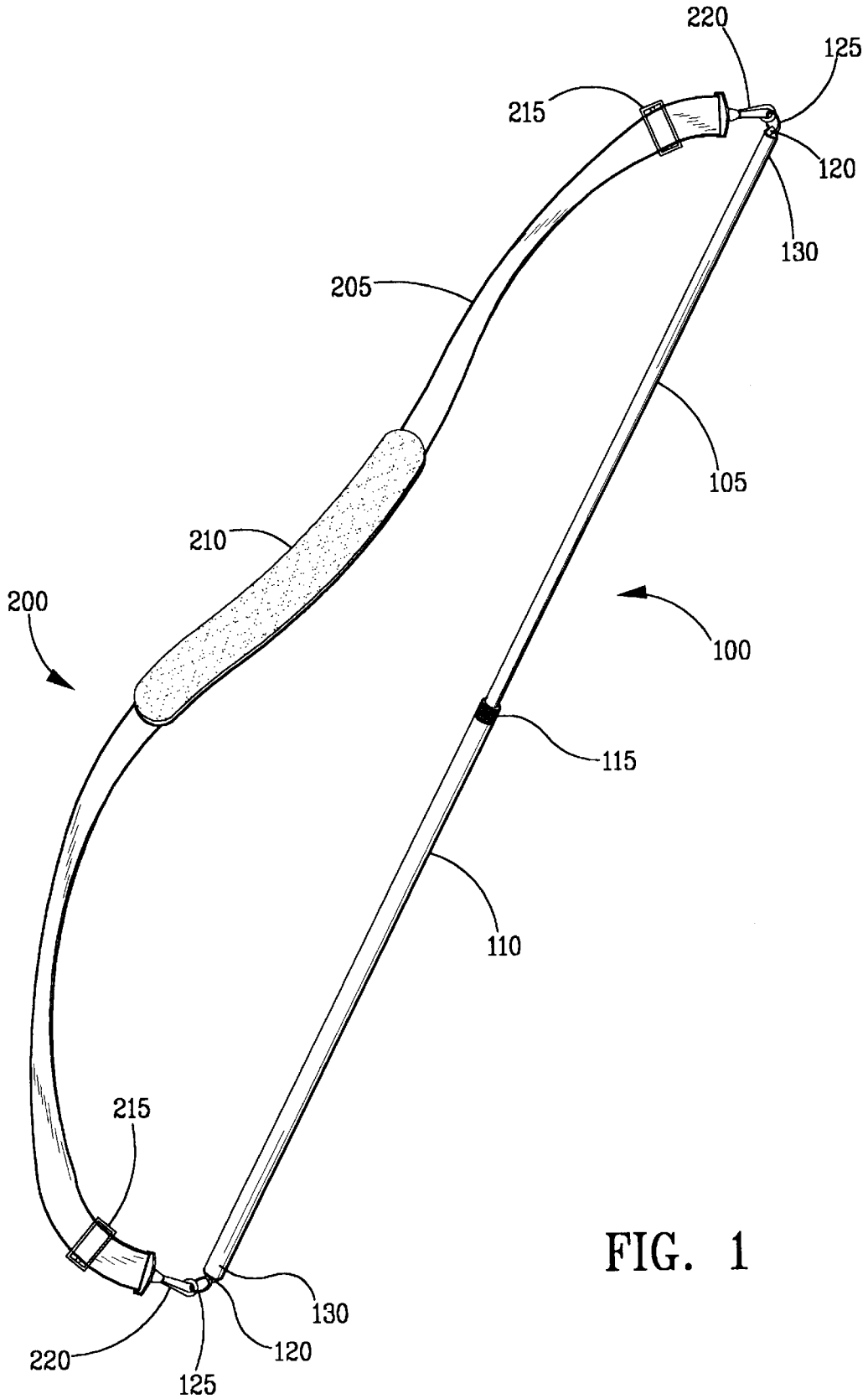
FIG. 1 is a perspective view of the invention.
Figure 2:
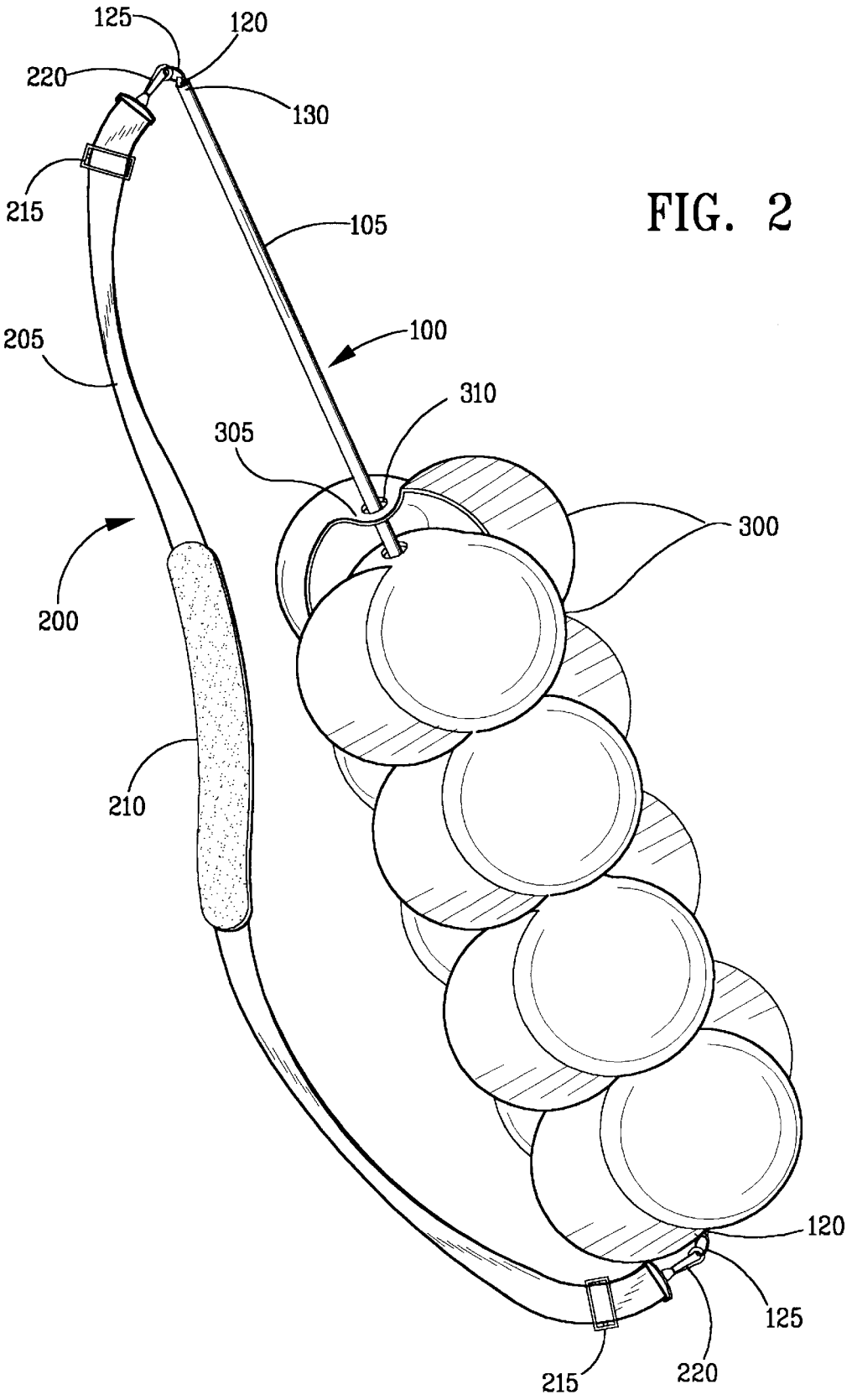
FIG. 2 is a perspective view of the invention with a plurality of protective helmets.

Referring to FIGS. 1–2, the invention (referred to as the holder) is shown with an adjustable pole (or insertion means), 100, and an adjustable strap (or carrying means), 200. The pole, 100, is preferably made of a metal, such steel or aluminum, although plastic or graphite or some other suitably rigid material could be used. The pole, 100, is most conveniently round, although other shapes could be used. The pole, 100, is constructed from an inner segment, 105, which slidably engages an outer segment, 110. Each segment, 105 and 110, has a length of approximately two feet. Each segment, 105 and 110, is hollow. The outer segment, 110, could have an outer diameter of approximately one-half of an inch and an inner diameter of slightly more than three-eighths of an inch. The inner segment, 105, could have an outer diameter of approximately three-eighths of an inch (so that the inner segment, 105, will slide into the outer segment, 110, easily but with minimal free play) and an inner diameter of approximately one-eighth of an inch. None of these dimensions are critical: the invention may be made with actual dimensions which will vary depending on the needs of the user.

The two segments, 105 and 110, are slidably connected to each other and may be held at a fixed length by a locking means, 115, such as a locking compression knob. The compression knob is well known in the art, and is comprised of a male inner element having male threads and a plurality of tapered, flexible tabs, and an outer element having female threads and a tapered portion. When the outer element is screwed onto the inner element the tapered portion of the outer element presses the flexible tabs of the inner element inward, creating increasing friction between the tabs and, for example, a pole passing through the center of the tabs. The compression knob is a particularly effective and inexpensive locking means, but it is certainly possible to substitute any number of other means for locking the two segments, 105 and 110, at a fixed length.

The pole, 100, has two ends and, disposed at each end, a spring steel clip, 120, and a ring, 125. The ring, 125, is preferably made of steel, although another suitably hard material may be used. The clip, 120, is a "V" shaped piece of spring steel which is sized to slide into one of the segments, 105 and 110, when the clip, 120, is slightly compressed. Each of the clips, 120, has an extrusion, 130, which fits snugly through a corresponding hole in the pole, 100. The ring, 125, is placed on the clip, 120, before the clip, 120, is inserted into either the outer segment, 110, or the inner segment, 105. It is important that the rings, 125, be sized so that they will pass easily through the ear-holes of protective helmets.

The strap, 200, has a fabric sling, 205, which is preferably made of a synthetic material, such as Nylon webbing. The sling, 205, may be of essentially any width, but will typically have a width of one to three inches. The sling, 205, has a padded element, 210, typically made from foam rubber covered with fabric.

The sling, 205, has two ends, and each end is threaded through a swivel buckle, 220, of the type well known in the art. Each end of the sling, 205, is then attached to a slideable buckle, 215, such that the overall length of the sling, 205, can be easily adjusted.

To use the holder, the end user will first loosen the locking knob, 115, and adjust the pole, 100, for a convenient length, which will determined by the number of helmets, 300, to be carried. The user then detaches one (and preferably only one) of the swivel clips, 220, from the rings, 125. It is most efficient to load the holder by taking the helmets, 300, in pairs, orienting each pair so that the ear-holes of the helmets are staggered and in a direct line with each other, as shown in FIG. 2. The pole, 100, is then threaded through the ear-holes, 310, located in the ear protecting portion, 305, of that pair of helmets, and the process is repeated until all helmets are loaded on the pole, 100. Once all the helmets, 300, are on the pole, 100, the user reattaches the swivel clip, 220, to the ring, 125. The helmets, 300, can be loaded and unloaded from either end of the pole, 100. The strap, 200, prevents the helmets, 300 from falling off of the pole, 100, and facilitates carrying the holder.

Each of the elements described above, or two or more together, may also find a useful application in other types of methods differing from the type described above. While certain novel features of this invention have been shown and described and are pointed out in the annexed claims, it is not intended to be limited to the details above, because various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A device for carrying a plurality of protective helmets with ear-holes comprising:

a. an outer cylindrical tube having a near end and a far end;

b. an inner cylindrical tube, having a near end and a far end, which is fitted slidably into the outer tube, where the inner and outer tube are of a size such that they will pass through the ear-holes;

c. a locking compression knob attached to the near end of the outer tube which receives the near end of the inner tube;

d. a first and a second spring steel clip attached to the far end of the inner tube and the far end of the outer tube, respectively;

e. a first and a second ring attached to the first and second steel clip where the first and second rings are of a size such that they will pass through the ear-holes;

f. a fabric strap having two ends;

g. a padded element cooperative with the strap;

h. a first and a second swivel hook attached to each end of the strap where each swivel hook detachably engages one of the rings;

i. a first and a second slideable buckle disposed near each end of the strap which allow the length of the strap to be adjusted.

2. A device for carrying a plurality of protective helmets with ear-holes comprising:

a. insertion means capable of being inserted through the ear-holes of the helmets, where the insertion means is of adjustable length, and where the insertion means has a first end and a second end;

b. a fabric strap, cooperative with the insertion means, for carrying the device, where the fabric strap has a first end and a second end and where the first and second end of the of the fabric strap detachably engages the first and second end, respectively, of the insertion means;

c. a padded element cooperative with the fabric strap;

d. a first and a second spring steel clip attached to the first end and the second end of the insertion means, respectively;

e. a first and a second ring attached to the first and second steel clip where the first and second rings are of a size such that they will pass through the ear-holes;

f. a first and a second swivel hook attached to each end of the strap where each swivel hook detachably engages one of the rings;

g. a first and a second slidable buckle disposed near each end of the strap which allow the length of the strap to be adjusted.

3. A device for carrying a plurality of protective helmets with ear-holes comprising:

a. a pole of adjustable length, having a first end and a second end, and having a maximum diameter which is small enough to fit through the ear-holes and further having a first steel clip attached to the first end of the pole and a second steel clip attached to the second end of the pole;

b. a strap of adjustable length, having a first end and a second end, where each end of the strap detachably engages one end of the is pole;

c. a first and a second ring attached to the first and second steel clip where the first and second rings are of a size such that they will pass through the ear-holes;

d. a padded element cooperative with the strap.

4. The device of claim 3 further comprising:

a. a first and a second swivel hook attached to each end of the strap where each swivel hook detachably engages one of the rings.

5. The device of claim 4 further comprising: a first and a second slidable buckle disposed near each end of the strap which allow the length of the strap to be adjusted.

* * * * *